US005275104A

United States Patent [19]

Corrado et al.

[11] Patent Number: 5,275,104

[45] Date of Patent: Jan. 4, 1994

[54] AUTOMATIC ROLL CLEANER

[76] Inventors: Frank C. Corrado, 33 Gateway Rd., Rochester, N.Y. 14624; Ronald G. Egan, 945 Joylene Dr.; Gary R. Larsen, 726 E. Circle, both of Webster, N.Y. 14580

[21] Appl. No.: 930,993

[22] Filed: Aug. 17, 1992

[51] Int. Cl.[5] ..... B41F 35/00

[52] U.S. Cl. ..... 101/425; 15/256.53

[58] Field of Search ..... 101/425, 423; 15/256.51, 256.52, 256.53; 198/494

[56] References Cited

U.S. PATENT DOCUMENTS

| | | | |
|---|---|---|---|
| 2,728,103 | 12/1955 | Benedict et al. | 15/256.53 |
| 3,615,397 | 10/1971 | Dimond et al. | 101/425 |
| 4,344,361 | 8/1982 | MacPhee et al. | 101/425 |
| 4,389,936 | 6/1983 | Jaffa et al. | 101/425 |
| 5,117,754 | 6/1992 | Nozava et al. | 101/425 |
| 5,150,650 | 9/1992 | Murakami | 101/425 |
| 5,150,653 | 9/1992 | Hara | 101/425 |

FOREIGN PATENT DOCUMENTS 2803370 8/1979 Fed. Rep. of Germany ... 15/256.53

*Primary Examiner*—Eugene H. Eickholt
*Attorney, Agent, or Firm*—Robert J. Bird

[57] ABSTRACT

Apparatus for cleaning a rotating process roll includes cleaning material supply and take-up rolls and a compliant touch roll, all mounted on a carriage adjacent to a process roll. Touch roll and cleaning material are moveable by air cylinders into and out of contact with the process roll. The touch roll is rotatable in one direction only with the take-up roll. A drive motor winds the take-up roll to incrementally and uniformly advance the cleaning material over the touch roll. Period and frequency of the cleaning cycle and sub-cycles are variable by microprocessor control. Supply roll and take-up roll are supported on retractable gudgeons for easy mounting and removal.

7 Claims, 5 Drawing Sheets

TIMING DIAGRAM

DECREMENT COUNTER FUNCTION

AUTOMATIC ROLL CLEANER

FIELD OF THE INVENTION

This invention relates to an automatic roll cleaner, and more specifically to apparatus for the cyclical cleaning of a process roller without interruption of its operation.

BACKGROUND INFORMATION

Printing, coating, calendering and other manufacturing operations in which rollers make continuous contact with the transported product, require that the surfaces of these process rollers be kept free of contamination in order to eliminate product defects. It is desirable that such process rollers be cleaned automatically during each production run to avoid down time of the manufacturing operation. This invention provides an improved automated system for the on-line cleaning of such process rollers as calender steel and compliant rollers, coating back-up rollers, printing blanket cylinders, etc.

The purpose and function of our automatic roll cleaner is to place a web of cleaning material against the surface of a spinning process roller a number of times during a production run without stopping the manufacturing operation. Contamination on the process roller is thus transferred to the cleaning material and removed from the manufacturing operation. By frequently removing contamination from the surface of the process rollers, the necessity for manual hand cleaning of these rollers is greatly reduced which further eliminates manufacturing down time. Most important, frequent cyclical cleaning of the process rollers, as is accomplished with our apparatus, improves the uniformity and quality of the product moving through the manufacturing operation.

The prior art that we know of is discussed, in relevant part, as follows:

U.S. Pat. No. 4,344,361 to MacPhee, issued Aug. 17, 1972 discloses an automatic blanket cylinder cleaner having a cleaning cloth for contact with the blanket cylinder. An expandable bladder intermittently presses the cloth against the cylinder as it rotates. The cleaning cloth advances intermittently from a supply roll to a take-up roll by means of a mechanical system, including a crank arm and a one-way clutch, to control the rotation of the take-up roll.

U.S. Pat. No. 2,525,982 to Wescott, issued Oct. 17, 1950 also discloses (see FIGS. 7,8) a cylinder cleaner having a web of cleaning material for contact with the cylinder as it rotates. The web is intermittently pressed against the cylinder by a cam mechanism to clean the cylinder. The cleaning web advances intermittently from a supply roll to a take-up roll by means of a mechanical system, including a crank arm and ratchet.

SUMMARY OF THE INVENTION

The present invention is an apparatus for cleaning a rotating process roll in a repetitive cleaning cycle. The system includes cleaning material supply and take-up rolls and a compliant touch roll, all mounted on a carriage adjacent to a process roll. The touch roll and cleaning material are movable by air cylinders into and out of contact with the process roll. The touch roll is rotatable in one direction only, with the take-up roll, in the tangential direction opposite that of the process roll. A drive motor winds the take-up roll to incrementally and uniformly advance the cleaning material over the touch roll. The period and frequency of the cleaning cycle and its sub-cycles are variable by microprocessor control. The supply roll and take-up roll are supported on retractable gudgeons for easy mounting and removal.

DRAWING

DESCRIPTION

Figure 1:
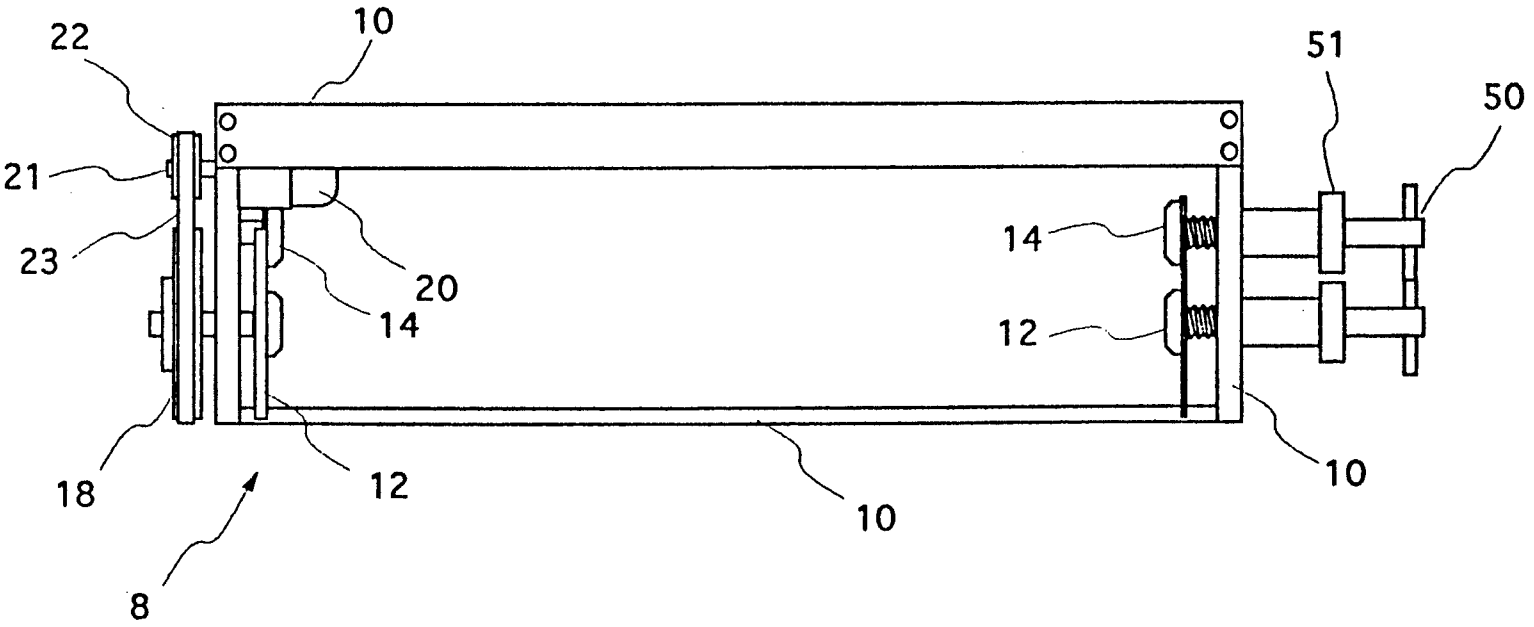
FIG. 1 is a front elevation of our automatic roll cleaner.
Figure 2:
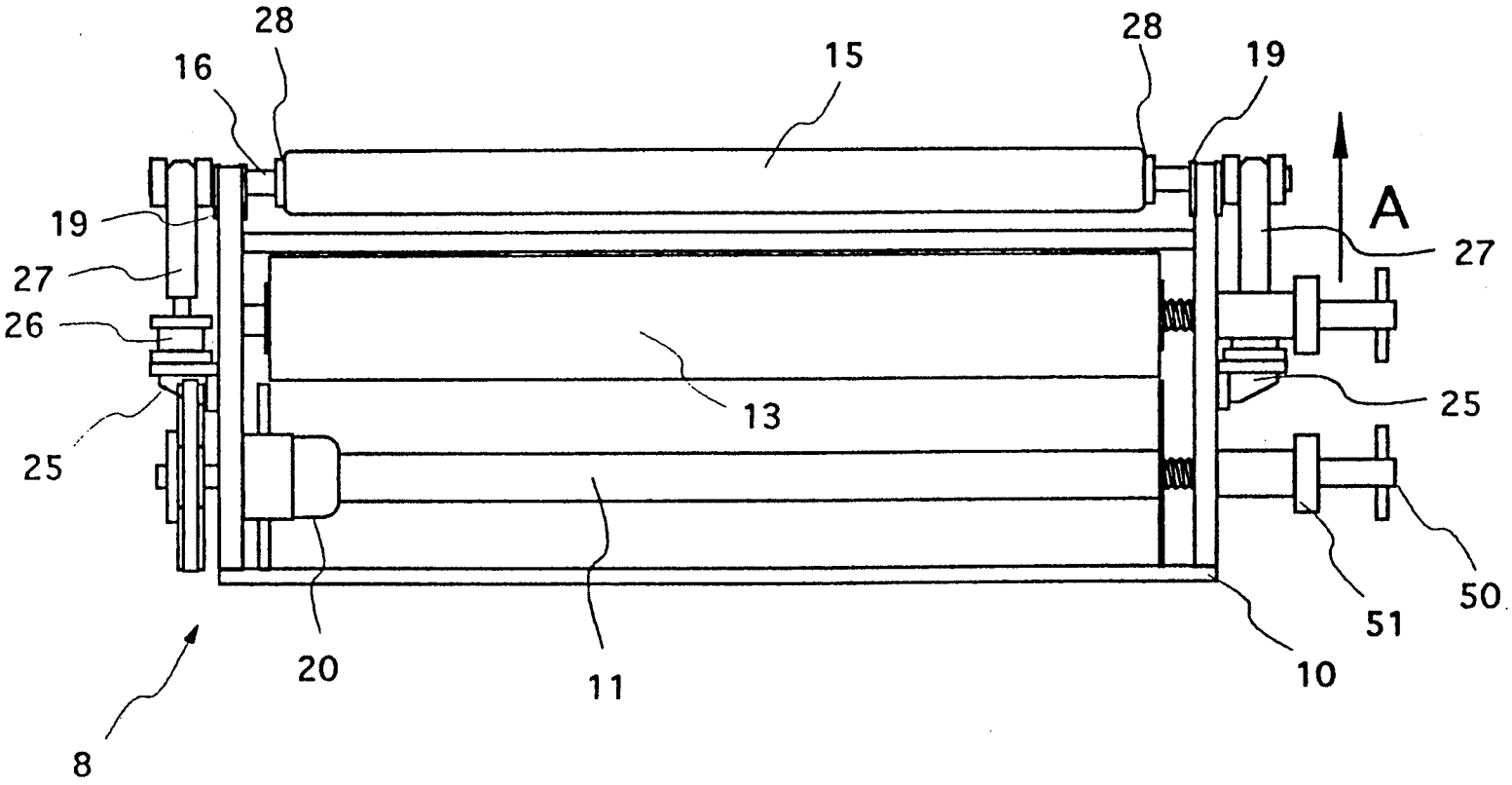
FIG. 2 is a partial top view of FIG. 1.
Figure 3:
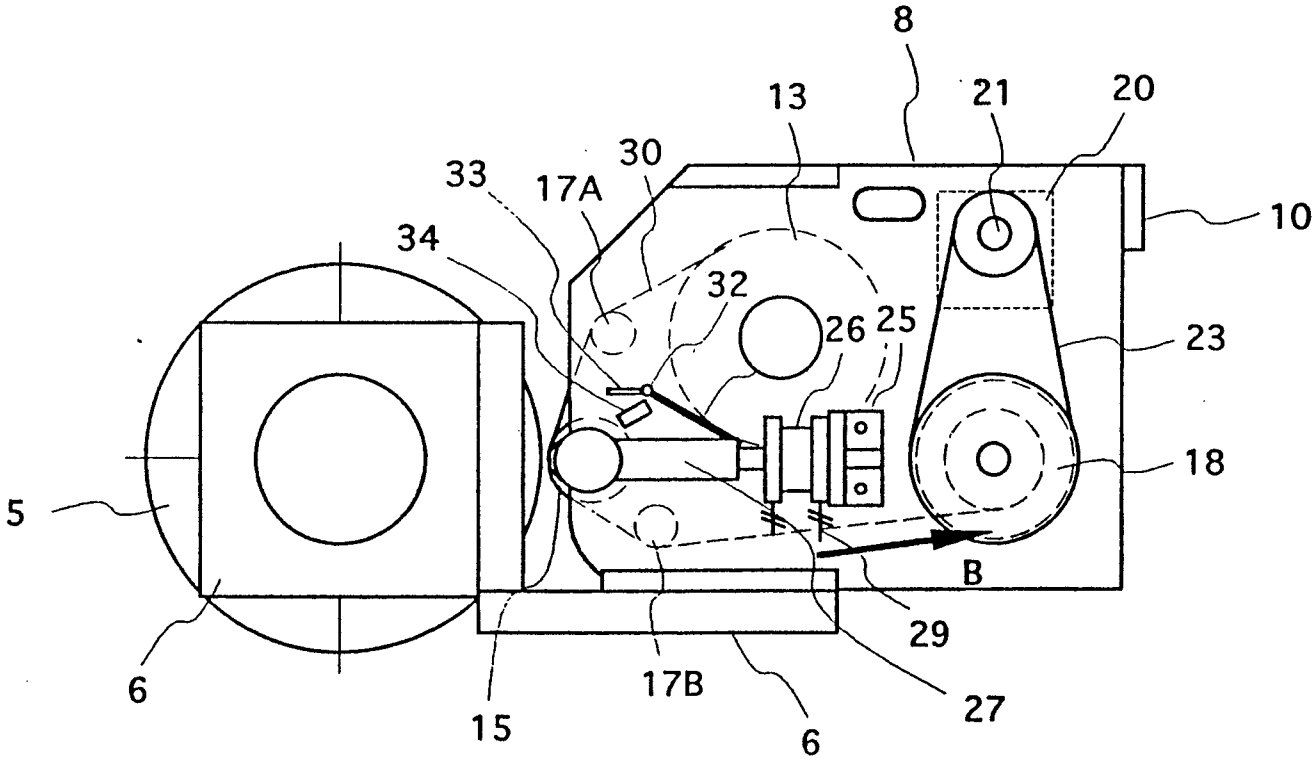
FIG. 3 is an enlarged left side view of FIG. 1.

Referring to FIGS. 1, 2, and 3, a process roll 5 is supported for rotation on a main frame 6. The roll cleaner assembly 8 is also supported on the main frame 6 (FIG. 3) in operative position relative to the process roll 5. The roll cleaner assembly 8 includes a carriage 10 supporting a take-up roll 11 for rotation on flanged gudgeons 12, a cleaning material supply roll 13 for rotation on gudgeons 14, and a rubber touch roll 15 on shaft 16. The cleaning material is transported over stationary web guides 17*a* and 17*b*. A pulley 18 is attached to the take-up roll flanged gudgeon 12. The touch roll shaft 16 is supported by the carriage in elongated slots 19 to permit movement of the shaft 16 toward and away from the process roll 5, as indicated by arrow A (FIG. 2).

FIG. 1 shows the cleaner assembly 8 without the cleaning material supply roll 13 and take-up roll 11. FIG. 2 shows the cleaner assembly with the cleaning material supply roll 13 and take-up roll 11 installed. FIG. 3 shows the cleaner assembly 8 and mounting frame 6 located with respect to process roll 5.

A drive motor 20, with drive shaft 21 and drive pulley 22 is mounted on the frame 10. The drive pulley 22 is connected to pulley 18 which is connected to the take-up roll flanged gudgeon 12, by a drive belt 23. The drive motor 20 is a stepper motor and is operatively connected to a power supply, not shown.

At each side of the carriage 10, a mounting bracket 25 supports a double acting cylinder 26 with a rod end 27 connected to the end of the piston rod. Rod end 27 supports the touch roll shaft 16, clutch bearing 28, and the touch roll 15. The clutch bearing 28 permits the touch roll 15 to rotate in one direction only. The air cylinders 26, and rod ends 27 provide lateral movement of the touch roll shaft 16 as indicated by arrow A. The double acting cylinders 26 are operatively connected through air supply ports 29 to a source of pressurized air, not shown, and to exhaust. Air to and from the cylinders 26 is controlled by four-way valves, not shown. The air lines and valving required to operate the air cylinders 26 is well known in the art and need not be described in detail.

Touch roll 15 is covered with a soft high temperature butyl rubber material to insure uniform contact pressure of the cleaning material 30 against the spinning process roll 5. The butyl rubber touch roll cover can withstand process roll temperatures up to 250 F. degrees.

Installation of the supply roll 13 and take-up roll 11 is accomplished by rotation of threaded T-handle bolt 50 and locking collar 51. The supply roll 13 is initially a full roll of cleaning material. The take-up roll 11 is initially empty. The take-up roll 11 is driven by motor 20 and belt 23 to intermittantly advance the cleaning material 30, from the supply roll 13 to the take-up roll 11. The take-up roll 11 pulls the cleaning material from supply roll 13, clockwise over touch roll 15, in the direction shown by arrow B.

An out-of material detector includes pivot arms 31 and 33 on a pivot axis 32. The first pivot arm 31 rests on the cleaning material on the supply roll 13. The second pivot arm 33 moves toward the out-of material sensor 34 as the cleaning material roll 13 gets smaller. When the cleaning material roll 13 is nearly empty, the second pivot arm 33 activates the out-of material sensor 34, which in turn halts the operating cycle of the automatic on-line roll cleaner. This out-of material condition is signaled to an operator with a flashing light and an audible alarm.

Figure 4:
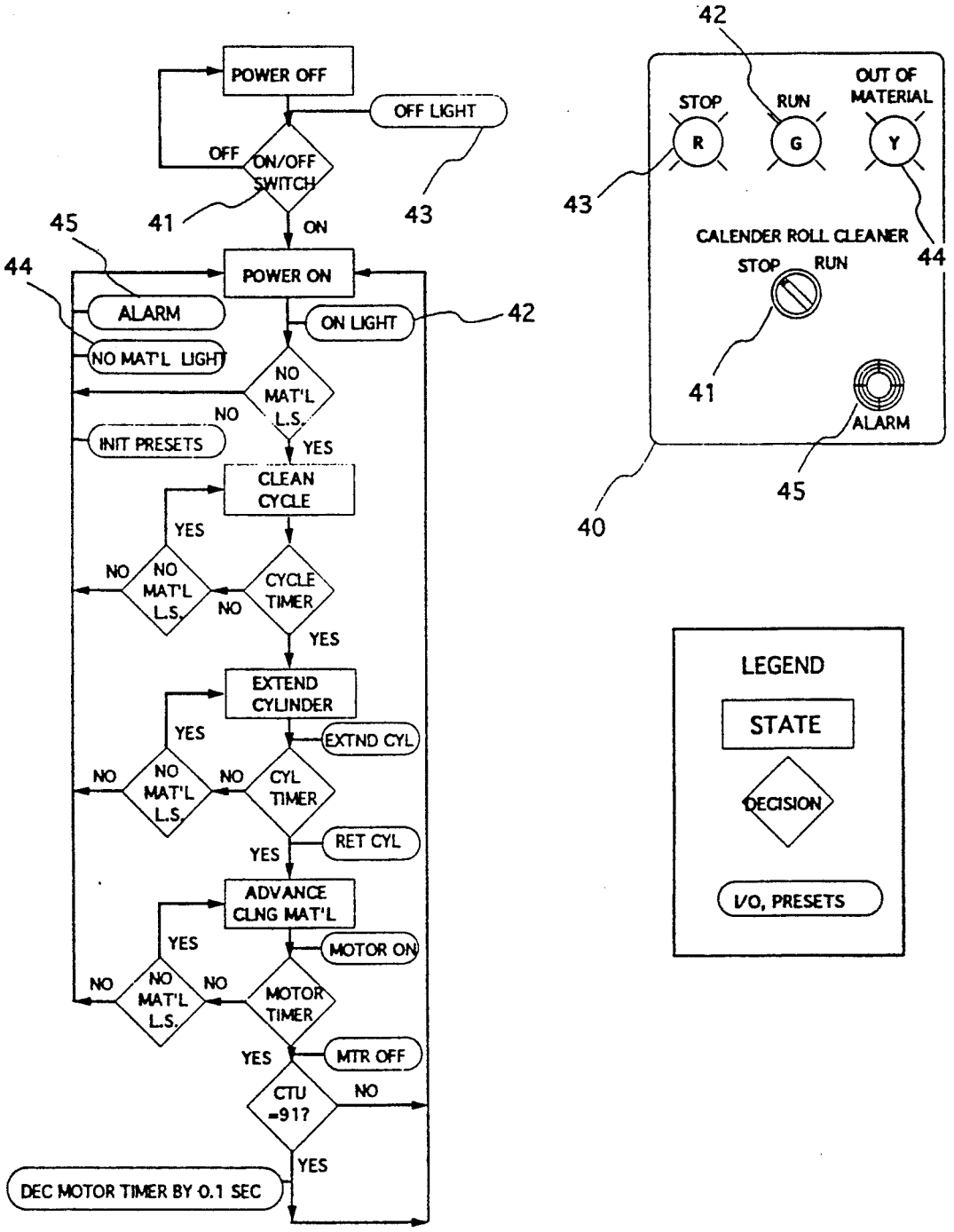
FIG. 4 is a logic diagram of the control system.
Figure 5:
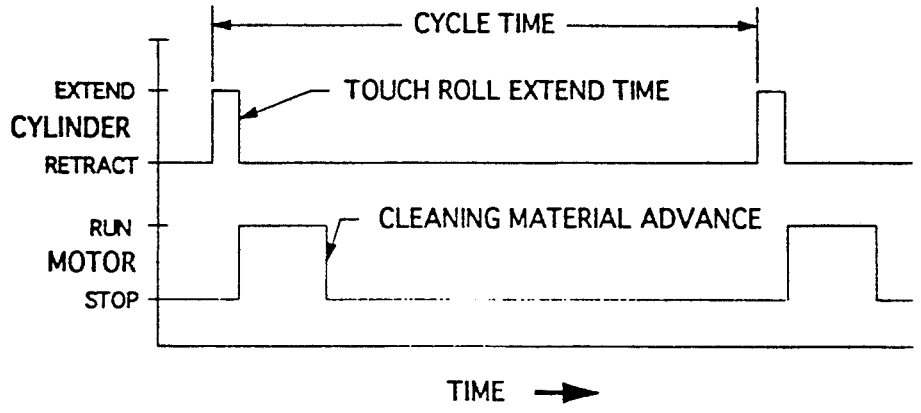
FIG. 5 is a timing diagram of the operation cycle.
Figure 6:
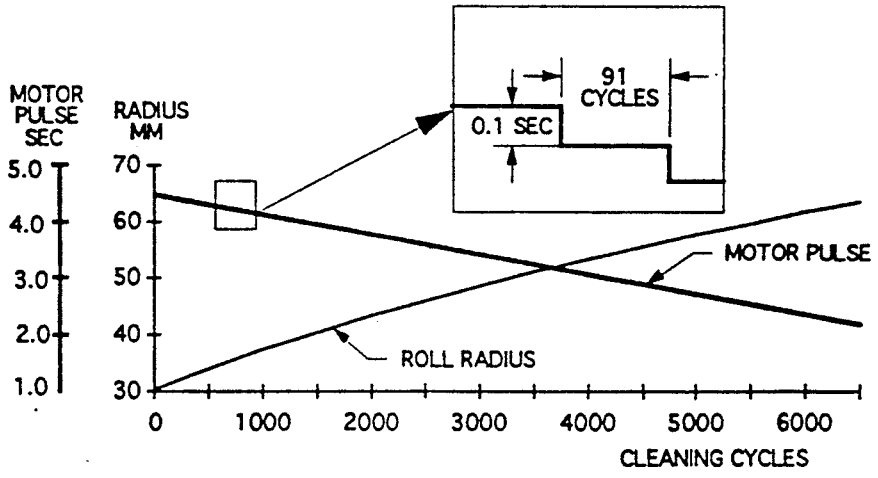
FIG. 6 is a curve relating motor drive time with take-up roll radius.

FIGS. 4, 5, and 6 show the logic and sequence of the operating cycle. The logic diagram of FIG. 4 includes a representation of an associated control panel 40, including ON-OFF switch 41, an ON light 42, an OFF light 43, an OUT-OF MATERIAL light 44, and an OUT-OF-MATERIAL alarm 45, all allowing the operator to stop and start the system and monitor its condition. The control panel and programmable logic controller (PLC) provide total automation of the system. The out-of material sensor signals the operator when the cleaning material roll requires change. The cleaning material advance program compensates for roll diameter changes to insure uniform material advance throughout the entire length of the roll.

The automatic on-line roll cleaner system 8 removes contamination deposits from the process roll 5 without interrupting the manufacturing operation. With switch 41 turned on, the cycle is as follows:

(1) The out-of material detector determines if the system has sufficient cleaning material to operate. If there is not sufficient cleaning material, the OUT-OF MATERIAL light will flash, the OUT-OF MATERIAL alarm will sound, and the system will not operate. If there is sufficient cleaning material to operate, the cycle timer will run for its preset time (e.g. 120 seconds).

(2) When the cycle timer has timed out, the four way air valves are energized, and air cylinder 26 extends the touch roll 15 wrapped with cleaning material 30 into contact with the spinning process roll 5 for a pre-programmed time period (e.g. 1.5 seconds) to clean the process roll as it rotates in its normal operation. When the cylinder extend timer has run, the air valves and cylinder 26 are again operated to retract the touch roll 15 and disengage the cleaning material 30 from the spinning process roll 5. The touch roll 15 does not rotate during its cleaning engagement with the spinning process roll 5. It is prevented from reverse rotation by the clutch bearings 28 so as to hold the cleaning material 30 stationary against the spinning process roll 5.

(3) While the touch roll 15 is retracted and the cleaning material 30 is disengaged from the process roll 5, the drive motor 20 advances the cleaning material 30 incrementally from supply roll 13 to take-up roll 11 to advance a clean portion in place for the next cycle. The motor pulse timer advances the cleaning material 30 over the touch roll 15 for a preset time (e.g. 4.6 seconds).

(4) To compensate for the changing diameter of the cleaning material rolls, and to minimize the amount of material used, a motor pulse counter counts the cleaning cycles that have been run and decrements the set point of the motor pulse timer in 0.1 second increments every 91 motor pulses.

(5) After the cleaning material 30 has advanced, the automatic cleaning cycle returns to the beginning and continues to repeat itself until the no-material condition is detected or the operator switches the auto cleaner to the OFF mode 41.

The program set points for the automatic roll cleaner can be modified as desired, as follows:

(a) The cycle timer controls the time interval between cleaning cycles. The set point is adjustable from 30 to 999 seconds. Preset is 120 seconds.

(b) The cylinder extend timer controls the time of contact between the touch roll wrapped with cleaning material and the spinning process roll. The set point is adjustable from 0.5 to 99.9 seconds.

(c) The motor pulse timer controls the amount of cleaning material advanced after each cycle. The set point is adjustable from 20 to 999 seconds, and should be adjusted whenever the cleaning material parameters change (d) The motor pulse counter maintains a constant cleaning material advance as the take-up roll diameter increases. FIG. 6 is a curve showing the motor drive pulse time decreasing as the radius of the take-up roll increases. The counter reduces the motor output pulse by a series of 0.1 second decrements. It can be programmed from 10 to 999 cycle counts. The counter must also be changed whenever the cleaning material parameters change.

The foregoing description of a preferred embodiment of this invention, including any dimensions, angles, figures, or proportions, is intended as illustrative. The concept and scope of the invention are limited only by the following claims and equivalents thereof. The term "process roll" in the claims is intended to include calendering, coating, printing, or other rollers either steel or polymeric.

What is claimed is:

1. Apparatus for cleaning a rotating process roll, including:

a carriage mounted on a frame adjacent to said process roll, said carriage supporting a cleaning material supply roll, a cleaning material take-up roll, and a touch roll on axes parallel to the axis of said process roll;

said touch roll supported by said carriage for movement toward and away from said process roll, said touch roll being rotatable with said take-up roll, and non-rotatable in the opposite direction;

fluid motors mounted on said carriage and operatively connected to the ends of said touch roll to move said touch roll cyclically toward and away from said process roll to thereby move said cleaning material into and out of contact with said process roll; and a drive motor operatively connected to said take-up roll to advance cleaning material from said supply roll, over said touch roll, onto said take-up roll after said touch roll is retracted from said process roll.

2. Apparatus as defined in claim 1, further including:

a cleaning material detector including a first pivot arm resting on material in said supply roll and pivotable with the decreasing diameter thereof, and a second pivot arm movable with said first pivot arm; and sensing means responsive to contact with said second pivot arm to signal an out-of-material condition and to discontinue operation of said apparatus.

3. Apparatus as defined in claim 1, further including:

means responsive to absence of cleaning material to discontinue operation of said apparatus; and means to count cycles of operation of said apparatus and to calculate supply roll diameter to shorten the time of operation of said drive motor in response to the number of said cycles to thereby advance said cleaning material in uniform increments.

4. Apparatus for cleaning a rotating process roll, including;

a carriage mounted on a frame adjacent to said process roll, said carriage supporting a cleaning material supply roll, a cleaning material take-up roll, and a touch roll on axes parallel to the axis of said process roll;

said touch roll supported by said carriage for movement toward and away from said process roll, said touch roll being rotatable with said take-up roll, in one direction only, in the tangential direction opposite that of said process roll;

fluid motors mounted on said carriage and operatively connected to the ends of said touch roll to move said touch roll cyclically toward and away from said process roll to thereby move said cleaning material into and out of contact with said process roll;

a drive motor operatively connected to said take-up roll to advance cleaning material from said supply roll, over said touch roll, onto said take-up roll after said touch roll is retracted from said process roll; and microprocessor control means to vary the period and frequency of said cleaning cycle and the individual components thereof, and to incrementally shorten the time of operation of said drive motor to compensate for changing diameter of said supply roll.

5. Apparatus as defined in claim 4, in which said touch roll is of a compliant material to press said cleaning material against said process roll with uniform contact pressure along the line of contact of said material and said roll.

6. Apparatus as defined in claim 5, in which said touch roll is of a high temperature resistant polymeric material to withstand process roll temperatures up to 250 F. degrees.

7. Apparatus as defined in claim 4, in which said supply roll and said take-up roll are supported on gudgeons, said gudgeons at one end being mounted on threaded bolts for retraction from engagement with said rolls to facilitate mounting and removal of said rolls.

* * * * *